United States Patent [19]

Soucy

[11] Patent Number: 4,854,584

[45] Date of Patent: Aug. 8, 1989

[54] GOLF REMINDER DEVICE

[76] Inventor: Etienne R. Soucy, 20 Ferncrest Ave., Coventry, R.I. 02816

[21] Appl. No.: 227,068

[22] Filed: Aug. 1, 1988

[51] Int. Cl.[4] ..... A63B 69/36

[52] U.S. Cl. ..... 273/183 B; 273/DIG. 17

[58] Field of Search ..... 273/183 B, 190 A, 190 B, 273/DIG. 17; 381/183, 187

[56] References Cited

U.S. PATENT DOCUMENTS

| | | | |
|---|---|---|---|
| 2,486,267 | 10/1949 | Dulinsky | 381/187 |
| 2,586,644 | 2/1952 | Gilbert | 381/183 |
| 3,874,672 | 4/1975 | Zank | 273/190 A |
| 4,754,484 | 6/1988 | Larkins et al. | 381/183 |

*Primary Examiner*—George J. Marlo

*Attorney, Agent, or Firm*—Salter & Michaelson

[57] ABSTRACT

A golf reminder device comprising a resilient headband adapted to frictionally engage the top of a wearer's head and extend thereacross, an arm member extending forwardly and downwardly from one end of said band and having a pad portion at its free extremity, said arm member being biased so as cause said pad to make pressurized engagement with the wearer's face at substantially the cheekbone area or slightly therebelow, said pressurized engagement functioning as a reminder to the user to keep his or her head down and still during the course of the golf swing.

1 Claim, 1 Drawing Sheet

GOLF REMINDER DEVICE

BACKGROUND OF THE INVENTION

This invention relates generally to a device designed to improve one's golf swing. More specifically, the device, which is adapted to be worn on the head of the user, functions as a reminder to the user to keep his or her head down and still while the golfball is being addressed, and throughout the golf swing.

Anyone who has ever played the grand and frustrating game of golf knows that one of the main problems in perfecting an effective golf swing is the tendency of the golfer to quickly lift his or her head or at the moment of impact or just before. The normal tendency of the average golfer is to quickly look up during the golf swing lest the golfer fail to see the long and straight path hopefully assumed by the golf ball after it has been struck. Unfortunately, however, quickly lifting or directing one's head upwardly during the golf swing adversely affects the fluidity and effectiveness of the swing, causing all kinds of terrible things, such as slices, hooks, etc. to happen. There probably isn't a golfer alive who after hitting a bad shot has not heard one of his or her playing partners say "You didn't keep your head down"!

It is this time-honored problem of failure to keep one's head down during the golf swing that the instant invention is designed to overcome.

SUMMARY OF THE INVENTION

The basic object of the present invention is to provide a reminder device that applies gentle, but readily discernable, pressure against the side of the user's face, said pressure serving as a mental reminder to the golfer to keep his or her head down and still while swinging at the ball. After one uses the instant invention over a period of time, the pressurized engagement of the device will in effect trigger a conditioned reflex that reminds and causes the golfer to keep his or her head down and over the ball throughout the swing.

The device of the present invention generally comprises a head-band that frictionally engages the top of the wearer's head and extends from side to side thereof. At one end of said band there is provided a forwardly and downwardly extending arm member having a pad portion at its free extremity. The arm member is normally biased so as to cause the said pad portion to make pressurized engagement with the side of the wearer's face, preferably adjacent the cheekbone area or slightly therebelow. This light, but discernable pressure will serve to remind the golfer to keep his or her head down and still while swinging at the ball.

The head-band and the arm member are both extensible so that the length thereof may be readily adjusted, and the connection between the arm member and head-band is such that the arm member may be rotated to a rearwardly disposed position to eliminate any inconvenience between shots. In addition, the rotatable mounting of the arm member permits the device to be readily adjusted for use by left and right hand golfers.

It is therefore an object of this invention to provide a golf reminder device which causes a light, but discernable pressure to be applied to the side of the face of the user to remind the person wearing the device to keep his or her head down and still while swinging at the golfball.

It is a further object to provide such a device which is readily adjustable for different size heads.

A still another object is the provision of such a device wherein the portion of the device that applies the pressure to the wearer's face may be retracted to a non-operable position when desired.

Another object is the provision of a golf reminder device that is easy and economically feasible to manufacture and that is effective in use.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
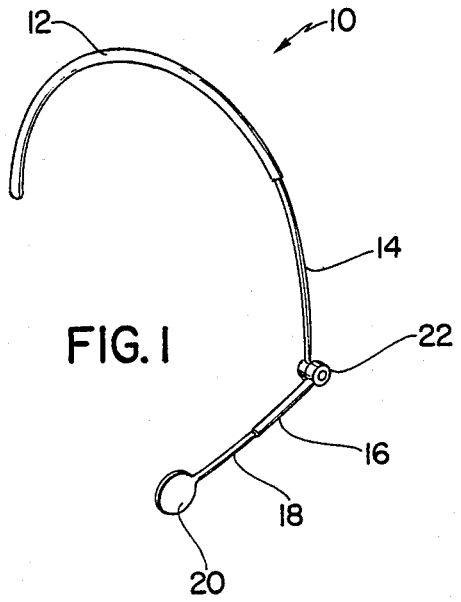
FIG. 1. is a perspective view of a golfer reminder device embodying the present invention.

Referring now to the drawings and more particularly FIG. 1, there is shown generally at 10 a golf reminder device embodying the present invention. The device 10 comprises a resilient head-band having telescoping portions 12 and 14 whereby the effective length of the head-band may be readily varied by slidably adjusting the portions 12 and 14 with respect to each other. The head-band may be constructed of any suitable resilient material, such as metal or plastic, and as will be noted, it is shaped to fit over the head of a wearer, extending generally from a point adjacent the top front of one ear to a point adjacent the top front of the opposite ear.

Figure 2:
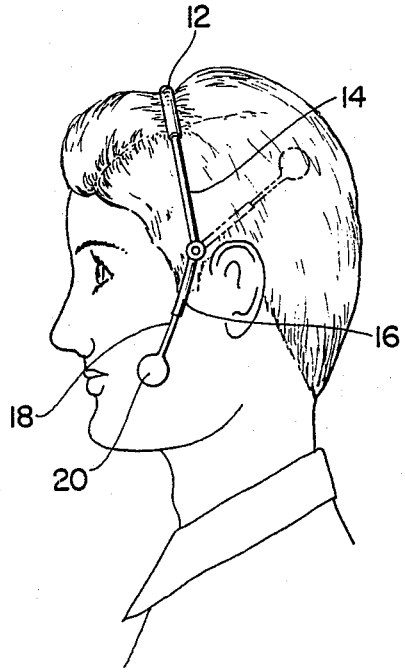
FIG. 2. is a side elevational view showing the device in its operable position in full lines, and in its inoperable position in broken lines.

At one end of the head-band, specifically at the end of portion 14, there is provided an arm member comprising telescoping portions 16 and 18, the portion 18 terminating in a rounded pad 20. For reasons hereinafter to be made apparent, the arm member is rotatably connected to the head-band as at 22 whereby the arm member may be swung from the operative position shown in full lines in FIG. 2 to the inoperative position shown in broken lines in FIG. 2. The arm member 16, 18 is normally biased so that pad 20 makes a light, but discernable pressure against the side of the face of the wearer, preferably at the cheekbone area or slightly therebelow.

Figure 3:
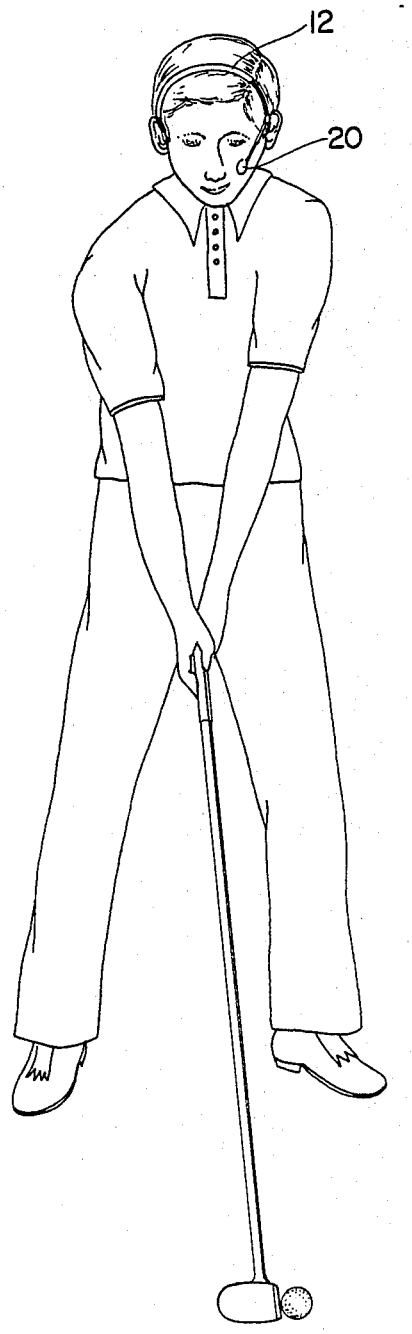
FIG. 3. is a front elevational view of a golfer wearing the device of the instant invention while addressing a golf ball.

For a righthanded golfer, as illustrated in FIG. 3, it has been found preferable to have the pressure pad 20 engage the left side of the user's face, while the opposite will obviously be true for a lefthanded golfer. It will therefore be seen that the rotatable mounting of the arm member 16, 18 with respect to the head-band 12, 14 permits the device 10 to be useable by both lefthand and righthand golfers. A further advantage of the rotatable mounting of the arm member is that after the golfer has completed his or her shot, the arm member may be swung from the full line position of FIG. 2 to the broken line position so as to minimize any inconvenience of the device between shots, it being understood that when the golfer is once again ready to hit his or her next shot, the arm member would again be swung to the full line position of FIG. 2.

The adjustability of the head-band 12, 14 and of the arm member 16, 18 permits the device 10 to be readily adjusted for different size heads and faces. It will be seen, however, that when the device has been properly adjusted and is positioned on the head of the wearer as illustrated in full lines in FIG. 2 and in FIG. 3, the gentle pressure of pad 20 will function as a reminder to the golfer, which eventually will become a conditioned reflex, to keep still and over the ball throughout the golf swing, or at least until after impact has been made.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A golf reminder device comprising a resilient band adapted to frictionally engage and extend across the top of a wearer's head from a point generally near the top front of one ear to a point generally near the top front of the other ear, means permitting ready adjustment of the length of said band, an arm member connected to and extending forwardly from one end of said band, means permitting ready adjustment of the length of said arm member, and a pad portion at the free end of said arm member, said arm member being normally biased toward the face of the wearer so that said pad portion makes pressurized engagement with the wearer's face at substantially the cheek area thereof, said arm member being rotatably connected to said band, whereby the direction in which said arm member extends from said band may be selectively reversed.

* * * * *